US006093527A

United States Patent [19]

Kagawa et al.

[11] Patent Number: 6,093,527

[45] Date of Patent: Jul. 25, 2000

[54] BENZIMIDAZOLOCARBOCYANINE DYE, AND SILVER HALIDE EMULSION AND SILVER HALIDE LIGHT-SENSITIVE PHOTOGRAPHIC MATERIAL CONTAINING THE SAME

[75] Inventors: Nobuaki Kagawa; Socman Hó ; Noriyasu Kita, all of Hino, Japan

[73] Assignee: Konica Corporation, Tokyo, Japan

[21] Appl. No.: 09/154,045

[22] Filed: Sep. 16, 1998

[30] Foreign Application Priority Data

Sep. 18, 1997 [JP] Japan ..... 9-253562

[51] Int. Cl.[7] ..... G03C 1/18

[52] U.S. Cl. ..... 430/585; 430/543; 430/583; 430/588

[58] Field of Search ..... 430/588, 583, 430/505, 543, 585

[56] References Cited

U.S. PATENT DOCUMENTS 4,741,995 5/1988 Tani et al. ..... 430/558
5,866,315 2/1999 Ho et al. ..... 430/588

*Primary Examiner*—Thorl Chea
*Attorney, Agent, or Firm*—Finnegan, Henderson, Farabow, Garrett & Dunner, L.L.P.

[57] ABSTRACT

A noble benzimidazolocarbocyanine dye represented by the following formulas is disclosed. A silver halide emulsion and a silver halide photographic material containing the dye are also disclosed.

13 Claims, 1 Drawing Sheet

BENZIMIDAZOLOCARBOCYANINE DYE, AND SILVER HALIDE EMULSION AND SILVER HALIDE LIGHT-SENSITIVE PHOTOGRAPHIC MATERIAL CONTAINING THE SAME

FIELD OF THE INVENTION

The present invention relates to a novel benzimidazolocarbocyanine dye; a silver halide emulsion which exhibits improvements in fog, sensitivity, and storage stability under the condition of high temperature and humidity, and exhibits excellent spectral sensitization in the green shorter wavelength region; and a silver halide light-sensitive photographic material employing the same.

BACKGROUND OF THE INVENTION

A silver halide light-sensitive color photographic material is regarded as a matured product with the extremely high degree of accomplishment. On the other hand, required improvements in the performance are branched to various qualities such as high sensitivity, high image quality, minimum variation in performance independent of storage conditions and the like. Furthermore, for the future, rapid access processing properties such as an increase in development speed are further required. In recent years, the required level has been increasingly elevated.

Particularly, regarding the increase in sensitivity, on account of technical progress of a digital camera, in order to keep the superiority of a silver halide light-sensitive color photographic material, a further increase in sensitivity is required, while maintaining low fog and excellent storage stability.

As the sensitivity increase technique of a silver halide emulsion, that is, sensitization technique, various methods are known, which are those regarding production of a silver halide emulsion; chemical sensitization thereof, spectral sensitization thereof; a design method of a silver halide light-sensitive material; development process thereof, and the like. Of them, the spectral sensitization technique which increases the sensitive region of a silver halide is indispensable in terms of efficient recording of information.

The spectral sensitization is performed by allowing a cyanine dye or merocyanine dye to be adsorbed to a silver halide crystal and by transferring light energy absorbed by the dye to the silver halide crystal as an energy acceptor.

Furthermore, it is known that in the visual sensation of human beings, the highest sensitivity is exhibited for green light. Therefore, it is particularly required that the a color photographic material has sufficient green sensitivity and appropriate spectral sensitivity.

In the silver halide light-sensitive color photographic material of the present invention, in order to realize excellent color reproduction, the green-sensitive layer is spectrally sensitized in the region of 500 to 600 nm and the spectral sensitivity maximum are preferably in the wavelength region of 530 to 540 nm.

Conventionally, many patents have disclosed the spectral sensitization in the green region. The spectral sensitization techniques are disclosed in which each of dyes described below is individually employed; oxacarbocyanine dyed described in U.S. Pat. Nos. 2,647,053, 2,521,705, and 2,072,908, and U.K. Patent No. 1,012,825, etc.; benzimidazolocarbocyanine dyes described in Japanese Patent Publication Nos. 38-7828, 43-14497, or U.K. Patent No. 815,172, and U.S. Pat. Nos. 2,778,823, 2,739,149, 2,912,329, 3,656,959, etc., and oxathiacarbocyanine dyes described in U.K. Patent No. 1,012,825.

Furthermore, supersensitization techniques obtained by the combination of oxacarbocyanine dyes with the other dyes are disclosed in Japanese Patent Publication Nos. 43-4936, 43-22884, 44-32753, 46-11627, and 48-25652, and Japanese Patent Publication Open to Public Inspection Nos. 46-38694, 57-14834, etc.

When the above-mentioned dyes are employed, green sensitivity is enhanced. However, because the spectral sensitization region is shifted to a longer wavelength, it becomes difficult to obtain excellent color reproduction.

As sensitizing dyes which spectrally sensitize a region having a wavelength shorter than 550 nm, those are known, for example, carbocyanine dyes described in Japanese Patent Publication No. 44-14030, Japanese Patent Publication Open to Public Inspection No. 51-31228, and U.S. Pat. No. 2,441,342; cyanine dyes described in U.S. Pat. Nos. 2,072,908 and 2,231,658, Germany Patent No. 973,291; dimethinemerocyanine dyes described in U.S. Pat. Nos. 2,493,748, 2,519,001, and 3,480,439. However, when any of these dyes is employed individually, a photographic emulsion having the high green sensitivity is not obtained. When the increase in sensitivity is intended, problems have been caused in that fog is liable to be caused and storage stability is liable to be degraded.

Furthermore, even though a conventional spectral sensitizing dye for the short wavelength known in the art such as disclosed in Japanese Patent Publication Nos. 50-40662, 48-41205, 46-7782, 51-107127, 51-115620, 52-18311, 52-37422, 63-197936, and 63-239436, is employed in combination, the shorter wavelength region of green light cannot be efficiently spectral-sensitized and the storage stability under the condition of high temperature and high humidity has not been satisfactory.

As dyes having a spectral sensitivity maximum in the shorter wavelength region of green light, benzimidazoloxacarbocyanines and polycyclic condensed thiacyanine are known. However, due to the unsymmetrical arrangement of heterocyclic groups and a structure having a short methine chain, the above-mentioned dyes have a low molecular extinction coefficient and even though spectral sensitivity spectrum is formed which has a spectral sensitivity maximum in the range of 530 to 540 nm, high sensitivity has not been sufficiently obtained.

In recent years, a technique is disclosed in which the maximum sensitization wavelength of benzimidazolocarbocyanine dyes with a large molecular extinction coefficient known as performing efficient spectral sensitization of the longer wavelength region of green light is shifted to the shorter wavelength.

For example, Japanese Patent Publication Open to Public Inspection Nos. 5-88293 and 6-509657 disclose a benzimidazolocarbocyanine dye forming the J-band in a relatively short wavelength near 550 nm in which a trifluoromethyl group is substituted onto a ring and a methyl group is substituted for a nitrogen atom, and Japanese Patent Publication Open to Public Inspection No. 9-59527 discloses a benzimidazolocarbocyanine dye which is substituted with an N-o-sulfobenzyl group, forming a J-band in a relatively short wavelengths near 540 to 560 nm.

When these dyes are employed singly or in combination, the sensitivity maximum is still in a longer wavelength region and a shift to the shorter wavelength region has been required.

Furthermore, Japanese Patent Publication Open to Public Inspection Nos. 6-118540 and 6-118588, and Japanese Patent Application Nos. 8-022446 and 8-129770 describe benzimidazolocarbocyanine dyes which combine with a benzimidazole ring via a sulfonyl group. However, the shift of a spectral sensitivity maximum to a shorter wavelength region of green light is not sufficient and all the properties such as sensitivity, fog, storage stability under the condition of high temperature and high humidity, etc. are not sufficient. Thus further improvements have been required.

SUMMARY OF THE INVENTION

An object of the present invention is to provide a novel benzimidazolocarbocyanine dye which may spectrally sensitize a short wavelength region of 530 to 540 nm of green light to result in increase in sensitivity without degrading the storage stability and fog of a silver halide emulsion, and a silver halide light-sensitive photographic material employing the same.

The above-mentioned object of the present invention has been accomplished by the following:

1. A compound represented by the following general formulas (1) or (2):

General formula (1)

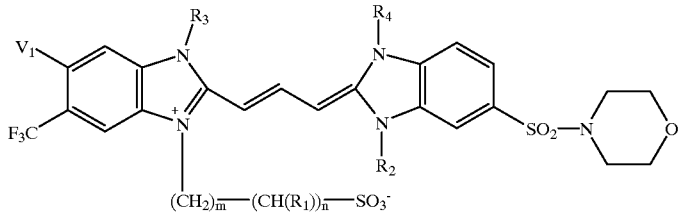

General formula (2)

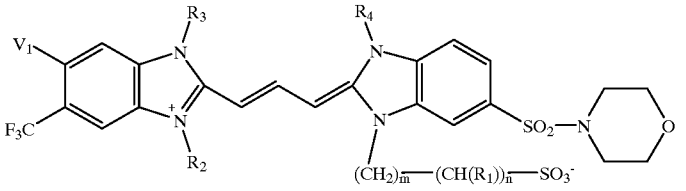

wherein $R_1$ represents a lower alkyl group, an aryl group or a heterocyclic group; $R_2$ represents a methyl or an ethyl group, each of which is substituted with an electron attractive group; $R_3$ represents a methyl group or an ethenyl group; $R_4$ represents a methyl group, an ethyl group or an ethenyl group; $V_1$ represents a hydrogen atom, a fluorine atom or a chlorine atom; m represents an integer of 2 to 4 and n represents 0 or 1;

2. A silver halide emulsion comprising a compound represented by general formulas (1) or (2) described above;

3. A silver halide light-sensitive photographic material comprising a support having thereon a silver halide emulsion layer comprising the silver halide emulsion described above; and 4. A silver halide light-sensitive color photographic material comprising a support having thereon a silver halide emulsion layer comprising the silver halide emulsion described above and a dye forming coupler.

DETAILED DESCRIPTION OF THE INVENTION

Figure 1:
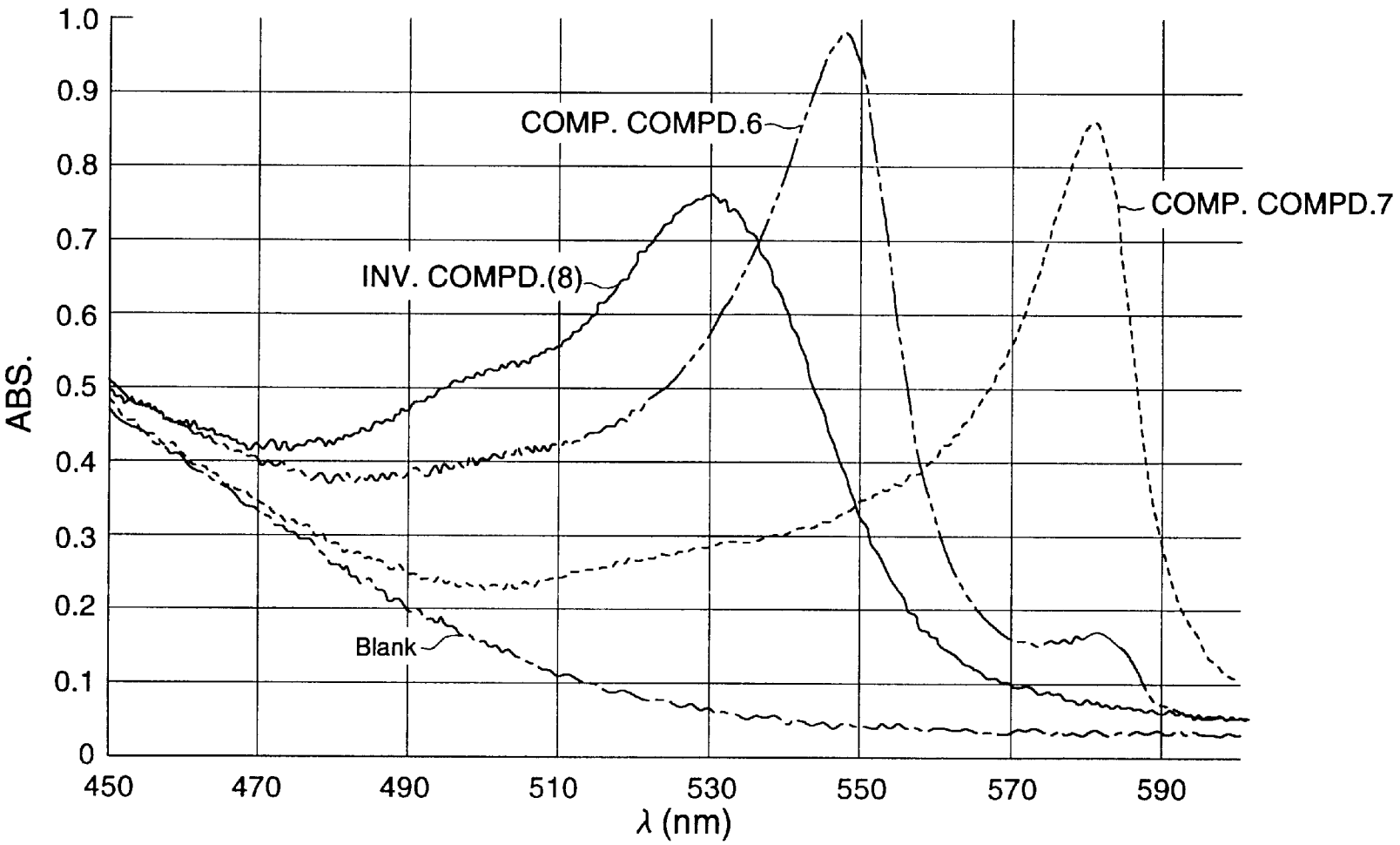
FIG. 1 shows reflection absorption spectra in the visible region of dyes contained in a silver halide emulsion.

In the above-mentioned general formulas (1) or (2), $R_1$ represents an lower alkyl group, an aryl group or a heterocyclic group. The lower alkyl group represented by $R_1$ has from 1 to 4 carbon atoms, such as methyl, ethyl, propyl and butyl. The aryl group, which may be substituted, is, for example, a phenyl group. Examples of substituents include a hydroxy group, a halogen atom (for example, a fluorine atom, a chlorine atom, a bromine atom, an iodine atom), a cyano group, an amino group (for example, an amino, methylamino, anilino, diethylamino, 2-hydroxyethylamino group, etc.), an acyl group (for example, an acetyl, benzoyl, propanoyl group, etc.), a carbamoyl group (for example, a carbamoyl, N-methylcarbamoyl, N,N-tetramethylenecarbamoyl, N-methanesulfonylcarbamoyl, N-acetylcarbamoyl group, etc.), an alkoxy group (for example, a methoxy, ethoxy, 2-hydroxyethoxy, 2-methoethoxy group, etc.), an alkoxycarbonyl group (for example, a methoxycarbonyl, ethoxycarbonyl, 2-methoxyethoxycarbonyl group, etc.), a sulfonyl group (for example, a methanesulfonyl, trifluoromethanesulfonyl, benzenesulfonyl, p-toluenesulfonyl group, etc.), a sulfamoyl group (for example, a sulfamoyl, N, N-dimethylsulfamoyl, morpholinosulfonyl, N-ethylsulfamoyl group, etc.), an acylamino group, (for example, an acetamido, trifluoroacetamido, benzamido, thienocarbonylamino, benzenesulfonamido group, etc.), an alkoxycarbonylamino group (for example, a methoxycarbonylamino, N-methylethoxycarbonylamino group, etc.).

The heterocyclic group represented by $R_1$ is a 5- to 7-membered heterocyclic ring containing an oxygen atom, a sulfur atom, and a nitrogen atom, or its condensed ring, and examples thereof include a piperazine ring, a quinoline ring, a pyridine ring, an isoquinoline ring, a 3H-indole ring, an oxazole ring, a thiazole ring, thiadiazole, a selenazole ring, an imidazole ring, a benzoxazole ring, a benzothiazole ring, a benzoselenazole ring, a benzimidazole ring, a pyrrole ring, a morpholine ring, a thiophene ring , a furan ring, etc.

The electron attractive group contained in $R_2$ has a Swain-Lupton substituent constant F of not less than 0.24, and examples thereof include cyano, nitro, a perfluoroalkyl group such as trifluoromethyl or nonafluorobutyl, an alkoxycarbonyl group such as methoxycarbonyl or ethoxycarbonyl, an acyl group such as acetyl or benzoyl, a carbamoyl group, a carboxy group, hydroxy, methoxy, and ethoxy.

The specific examples of the present invention are shown below. However, the compounds of the present invention are not limited to these examples.

(1)

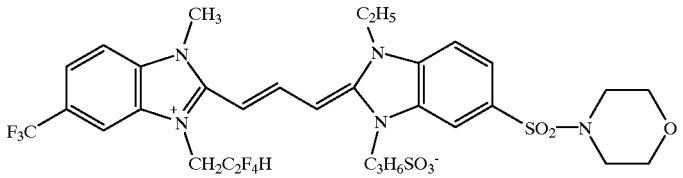

(2)

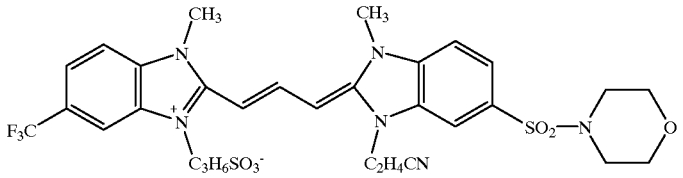

(3)

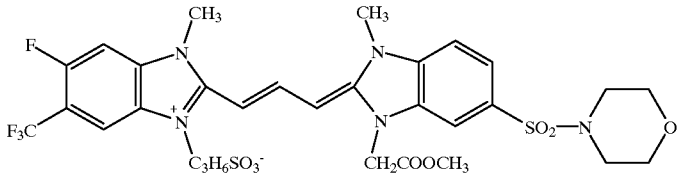

(4)

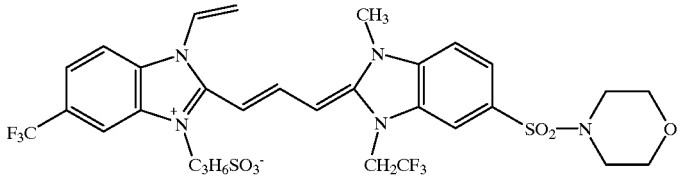

(5)

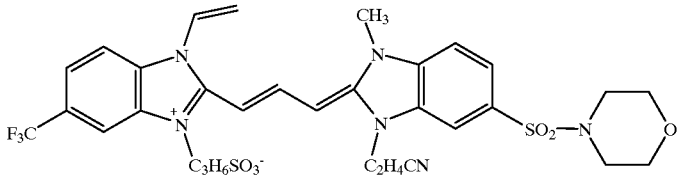

(6)

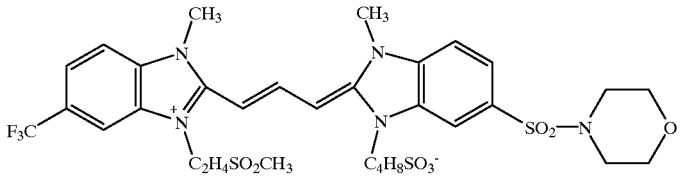

(7)

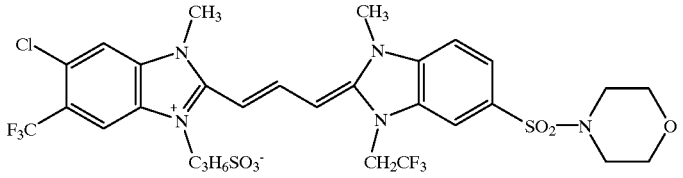

-continued
(8)
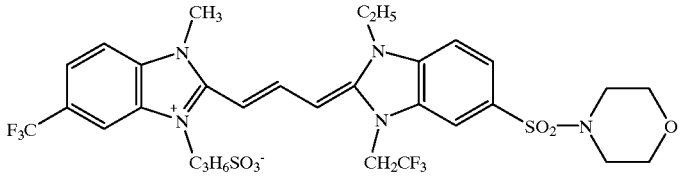
(9)
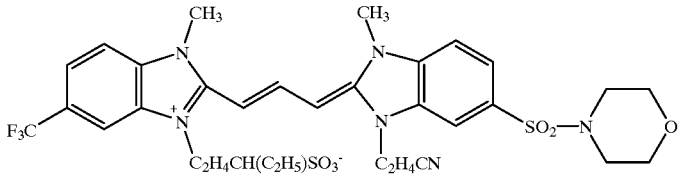
(10)
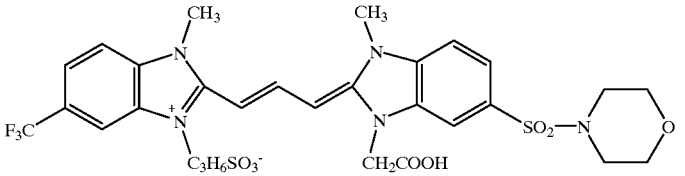
(11)
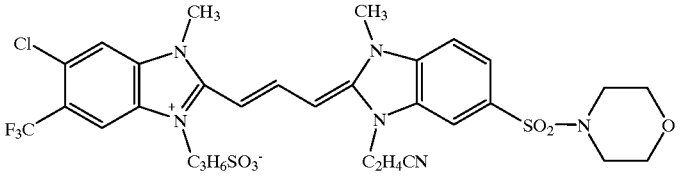
(12)
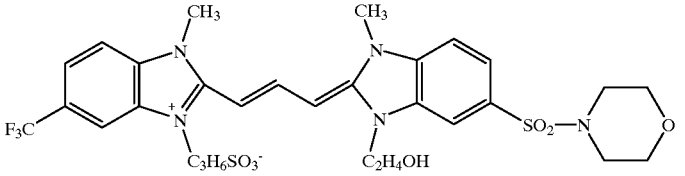
(13)
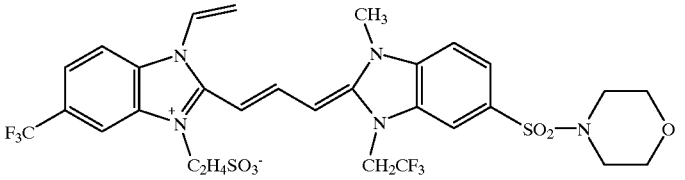
(14)
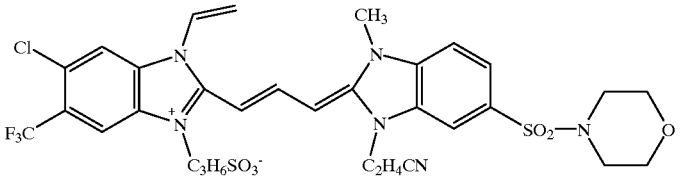
(15)
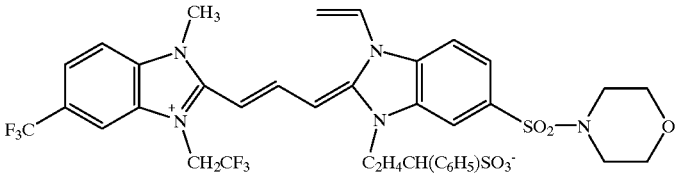

-continued (16)

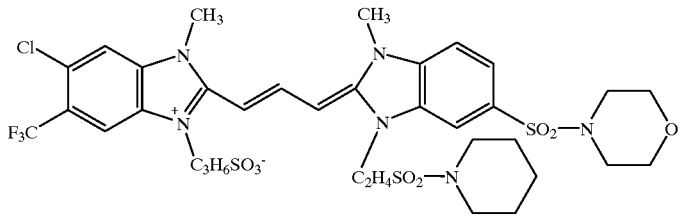

(17)

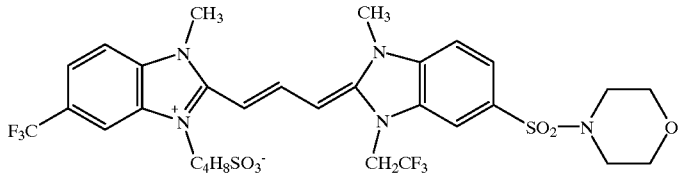

(18)

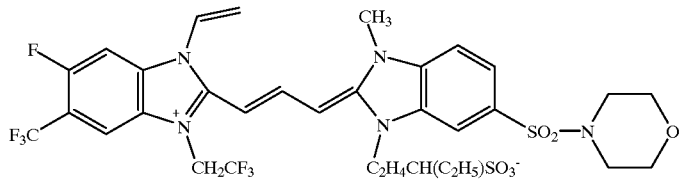

The compounds represented by general formulas (1) and (2) can be readily synthesized by conventional methods known in the art, described in the publications, for example, F. M. Hamer, "Cyanine Dyes and Related Compounds", John Wiley & Sons, New York, London, 1964, published by Interscience Publishers, D. M. Sturmer, "Heterocyclic Compounds Special Topics in Heterocyclic Chemistry", John Wiley & Sons, New York, London 1997, etc.

The compounds represented by the above-mentioned general formulas (1) and (2) can be added to a silver halide emulsion employing conventional methods known in the art. For example, a method mentioned below is optionally selected and the dissolved compound is added to an emulsion; a protonation dissolution addition method described in Japanese Patent Publication Open to Public Inspection Nos. 50-80826 and 50-80827 describe; a dispersion addition method together with a surface active agent described in U.S. Pat. No. 3,822,135, Japanese Patent Publication Open to Public Inspection No. 50-11419 describe; a addition method in which a compound is dispersed into a hydrophilic medium described in U.S. Pat. Nos. 3,676,137, 3,469,987, 4,247,627, Japanese Patent Publication Open to Public Inspection Nos. 51-59942, 53-16624, 53-102732, 53-102733, 53-137131 describe; an addition method forming a solid solution described in East German Patent No. 143,324, or an addition method by dissolving a dye described in Research Disclosure No. 21802, Japanese Patent Publication 50-40659, Japanese Patent Publication Open to Public Inspection No. 59-148053 in a water-soluble solvent, such as a low boiling point solvent (for example, water, methanol, ethanol, propyl alcohol, acetone, fluorinated alcohol, etc. or a high boiling point solvent (for example, dimethylformamide, methylcellosolve, phenylcellosolve, etc.).

The compound represented by the above-mentioned general formulas (1) and (2) may be added at any time during the emulsion preparing process from physical ripening to the completion of chemical ripening and coating, and is preferably added during the emulsion preparing process from physical ripening to the completion of chemical ripening.

During the process of physical ripening and chemical ripening, the addition of the compound of the present invention prior to the addition of a chemical sensitizer, or immediately after the addition thereof is preferably carried out because the spectral sensitization is more effected.

The added amount of the compound represented by general formulas (1) and (2) depends remarkably on employed conditions and types of emulsions. However, the monomolecular layer covering ratio on the surface of light-sensitive silver halide emulsion grains is preferably adjusted to the range of 40 to 90 percent and is more preferably adjusted to the range of 50 to 80 percent. In the present invention, the monomolecular covering ratio is determined as a relative value, in which, when the absorption isotherm line is prepared at 50° C., the saturated adsorption amount is defined as a covering ratio of 100 percent. The added amount of the compound represented by formula (1) or (2), which may be variable with the total grain surface of the emulsion, is preferably less than 600 mg per mol of silver halide, and more preferably less than 450 mg per mol of silver halide.

The silver halide emulsion of the present invention may be employed in combination of a conventional methine dye known in the art and the employed ratio in the combination may be optionally chosen depending to the amount to result in desired sensitivity.

Furthermore, an emulsion may be added with a supersensitizer such as a dye having no spectral sensitizing function or a compound which does not substantially absorb visible light, which enhances sensitization of a sensitizing dye.

Sensitizing dyes include cyanine dyes, merocyanine dyes, complex cyanine dyes, complex merocyanine dyes, homopolarcyanine dyes, hemicyanine dyes, stryl dyes, hemioxonol dyes, polymethine dyes comprising oxonol, styryl and streptocyanine, etc.

The silver halide emulsion of the present invention may be subjected to chemical sensitization employing each or combination of chalcogen sensitization such as sulfur sensitization, selenium sensitization, tellurium sensitization, etc., reduction sensitization, and noble metal sensitization. There is no particular limitation on the conditions of the chemical sensitization process, for example, pH, pAg, temperature, time, etc., and the conditions generally employed in this industry may be employed.

In the sulfur sensitization, may be employed preferred sulfur compounds such as thiourea derivatives such as 1,3-diphenylthiourea, triethylthiourea, 1-ethyl-3-(2-thiazolyl)-thiourea, rhodanine derivatives, dicarbamine salts, polysulfide organic compounds, thiosulfate salts, sulfur monomer, etc. Further, the sulfur monomer preferably includes α-sulfur belonging to an orthorhombic crystal system.

In addition, sulfur sensitizers may be employed which are described in U.S. Pat. Nos. 1,574,944, 2,410,689, 2,278,947, 2,728,668, 3,501,313, and 3,656,955; West German OLS Patent No. 1,422,869; Japanese Patent Publication Open to Public Inspection Nos. 56-24937 and 55-45016, etc.

In the selenium sensitization, selenium compounds may be employed which are described in U.S. Pat. Nos. 1,574,944, 1,602,592. and 1,623,499; Japanese Patent Publication Open to Public Inspection Nos. 60-150046, 4-25832, 4-109240, and 4-147250, etc.

Useful selenium sensitizers include colloidal selenium, isoselenocyanates (for example, an arylisoselenocyanate, etc.); selenoureas (for example, N,N-dimethylselenourea, N,N,N'-trimethyl-N'-heptafluoroselenourea, N,N,N'-trimethl-N'-heptafluoropropylcarbonylselenourea, N,N,N'-trimethyl-N'-4-nitrophenylcarbonylselenourea, etc.); selenoketones (for example, selenoacetone, selenoacetophenone, etc.); selenoamide (for example, selenoacetoamide, N,N-dimethylselenobenzamide, etc.); selenocarboxylic acids and selenoesters (for example, 2-selenopropionic acid, methyl-3-selenobutylate, etc,.); selenophosphates (for example, tri-p-triselenophosphates); selenides (for example, dimethylselenide, triphrenylphosphineselenide, pentafluorophenyl-diphenylphosphineselenide, etc.).

Particularly preferred selenium sensitizers include selenourea, selenoamides, selenides.

The techniques employing these selenium sensitizers are disclosed in U.S. Pat. Nos. 1,574,944, 1,602,592, 1,623,499, 3,297,466, 3,297,447, 3,320,069, 3,408,196, 3,408,197, 3,442,653, 3,420,670, and 3,591,385; French Patent Nos. 2,693,038 and 2,093,209; Japanese Patent Publication Nos. 52-34491, 52-34492, 53-295, and 57-22090, Japanese Patent Publication Open to Public Inspection Nos. 59-180536, 59-185330, 59-181337, 59-187338, 59-192241, 60-150046, 60-151637, 61-246738, 3-4221, 3-24537, 3111838, 3-116132, 3-14864E, 3-237450, 4-16838, 4-25832, 4-32831, 4-96059, 4-109240, 4-140738, 4-140739, 4-147250, 4-184331, 4-190225, 4-191729, and 4-195035, U.K. Patent Nos. 255,846 and 861,984; and E. Spencer, et al, Journal of Photographic Science, Volume 31, pages 158 to 169 (1983).

The tellurium sensitization is disclosed in U.S. Pat. Nos. 1,623,499, 3,320,069, 3,772,031, 3,531,289, and 3,655,394; U.K. Patent Nos. 235,211, 1,121,469, 1,295,462, and 1,396,696; Canadian Patent No. 800,958; and Japanese Patent Publication Open to Public Inspection No. 42-20464. Examples of tellurium sensitizers include tellurium compounds such as phosphine tellurides (for example, butyl-diisopropylphosphine telluride, tributylphosphine telluride, etc.); telluroureas (for example, N,N-dimethylethylenetellurourea, N,N-diphenylethylenetellurourea, etc.), telluroamides, etc.

Regarding the noble metal sensitization, noble metal salts of gold, platinum, palladium, iridium, osmium, etc. may be employed which are described in Research Disclosure, Volume 307, Item 307105, etc.

Examples of useful gold sensitizers include chloroauric acid, gold thiosulfate, gold thiocyanate, etc. and organic gold compounds disclosed in U.S. Pat. Nos. 2,597,856 and 5,049,485, Japanese Patent Publication No. 44-15748, Japanese Patent Publication Open to Public Inspection Nos. 1-147537, 4-70650, etc. In addition, its combination with chalcogen sensitization is preferred.

Addition methods of the above-mentioned various sensitizers include a method in which according to the properties of a compound employed, it is dissolved in a single solvent or mixed solvent of water, methanol, etc. and is added; a method in which a compound solution is previously mixed with a gelatin solution and is then added; a method disclosed in Japanese Patent Publication Open to Public Inspection No. 4-140739 in which a compound is added in a state of an emulsified dispersion of a mixed solution with a organic solvent-soluble polymer, etc.

The silver halide emulsion of the present invention is may be subjected to chemical sensitization in the presence of a silver halide solvent. The silver halide solvents employed in the present invention include organic thioethers described in U.S. Pat. Nos. 3,271,157 and 3,574,628, Japanese Patent Publication Open to Public Inspection Nos. 54-1019 and 54-158917, etc.; thiourea derivatives described in Japanese Patent Publication Open to Public Inspection Nos. 53-82408, 55-77737, and 55-2982; silver halide solvents having a thiocarbonyl group positioned between an oxygen or sulfur atom and a nitrogen atom described in Japanese Patent Publication Open to Public Inspection No. 53-144319; imidazoles, sulfite salts, thiocyanate, etc. described in Japanese Patent Publication Open to Public Inspection No. 54-100717.

In the reduction sensitization, may be employed reducing compounds described in Research Disclosure, Volume 307, Item 307105 and Japanese Patent Publication Open to Public Inspection No. 7-78685.

Specific reducing compounds include aminoiminomethanesulfinic acid (or thiourea dioxide), borane compounds (for example, dimethylamine borane, etc.), hydrazinecompounds (for example, hydrazine, p-tolylhydrazine, etc.), polyamine compounds (for example, diethylenetriamine, triethylenetetramine, etc.), stannous chloride, silane compounds, reductones (for example, ascorbic acid, etc.), sodium sulfite, aldehyde compounds, hydrogen gas, etc.

Furthermore, the reduction sensitization may be conducted under high pH and excess silver ions as disclosed in Japanese Patent Publication Open to Public Inspection Nos. 8-277938, 8-251486, 8-182035, etc.

General stabilizers can be incorporated into a silver halide photographic emulsion comprising silver halide grains subjected to reduction sensitization. In addition, when, for example, antioxidants disclosed in Japanese Patent Publication Open to Public Inspection No. 57-82831, or thiosulfonic acids described in V. S. Gahler, Zeitschrift fur Wissenschaftliche Photographie, Bd. 63, 133 (1969) and Japanese Patent Publication Open to Public Inspection No. 54-1019 are employed together with the stabilizer, excellent results are often obtained. Further, these compounds may be added during any emulsion making process from crystal growth to the preparation process just before coating.

To the silver halide emulsion of the present invention may be added fine silver iodide grains during the process from chemical ripening to coating. The process from chemical ripening to coating herein includes the period during chemical ripening and covers the process until coating.

Furthermore, the fine silver iodide grains employed in the present invention may be either γ-AgI in a cubic crystal system or β-AgI in a hexagonal crystal system, which may be employed individually or in combination.

The fine silver iodide grains of the present invention may be added during any process from chemical ripening to the period just before coating, but are preferably added during the chemical ripening.

The chemical ripening process in the present invention refers to a process from the time when physical ripening and a salt removal operation of the emulsion of the present invention are completed to the time when an operation is conducted to terminate the chemical ripening. Furthermore, the fine silver iodide grains may be intermittently added several times, and after the addition of the fine silver iodide grains, another chemical-ripened emulsion may be added. When the fine silver iodide grains are added, the temperature of the emulsion in a liquid state is preferably in the range of 30 to 80° C. and more preferably in the range of 40 to 65° C.

As the silver halide grains of the silver halide emulsion of the present invention, those of silver bromide, silver iodobromide, silver iodochloride, silver chlorobromide, silver chloroiodobromide, silver chloride, etc. can optionally employed. However, particularly, silver iodochlorobromide or silver chlorobromide having a silver chloride content ratio of not less than 60 mole percent, or silver chloride is preferred.

Any shape of the silver halide grain used in the present invention may be employed. For example, can be employed the grain having the shape of a cube, an octahedron, tetradecahedron, a sphere, a tabular, a potato-shaped, (etc. Particularly, the tabular silver halide grain is preferably employed.

The tabular silver halide grain employed in the present invention is explained below.

The tabular silver halide grain which is preferably employed in the present invention is crystallographically classified into a twinned crystal. The twinned crystal is a silver halide crystal having at least one twin plane in one grain. The classification of the twin shapes is described in detail in Klein and Moiser, Photographisches Korrespondenz, Volume 99, page 99 and Volume 100, page 57.

The tabular silver halide grain which is preferably employed in the present invention mainly has parallel twin planes of even number. These twin planes may be either parallel or non-parallel each other. The grain having two twin planes is particularly preferred.

The ratio of grain diameter/thickness (aspect ratio) of the tabular silver halide grain employed in the present invention is not less than 2. The average aspect ratio is preferably between 2 and 12 and more preferably between 3 and 8.

The exterior wall of the above-mentioned tabular silver halide crystal may be substantially composed almost of a {111} plane or {100} plane, or may be composed of {111} and {100} planes in combination. In this case, the grain surface area is composed of the {111} plane of not less than 50 percent, more preferably the {111} plane between 60 and 90 percent, and most preferably the {111} plane between 70 and 95 percent.

The planes other than the {111} plane are preferably composed mainly of the {100} plane. A plane ratio can be obtained by utilizing the difference in adsorption of a sensitizing dye onto the {111} plane and the {100} plane (refer to T. Tani, J. Imaging Sci., Volume 29, page 165 (1985)).

The tabular silver halide grains employed in the present invention may be either polydispersed grains or monodispersed grains, but the monodispersed grains are preferred. Specifically, when a distribution width is defined employing a relative standard deviation (variation coefficient) represented by (standard deviation of grain diameter/average grain diameter)×100=distribution width (%), grains with not more than 25% are preferred, those with not more than 20% are more preferred, and those with not more than 15% are most preferred.

The tabular silver halide grain employed in the present invention is preferably hexagonal. The hexagonal tabular silver halide grain (hereinafter referred to as hexagonal tabular grain) is that the shape of the major faces ({111} face) is hexagonal and the maximum adjacent edge ratio is between 1.0 and 2.0. The maximum adjacent edge ratio herein is a ratio of the maximum edge length of the hexagon to the minimum edge length.

In the present invention, if the maximum adjoining side ratio is between 1.0 and 2.0, the corner may be round. When the corner is round, the length of a side is represented by the length between intersecting points of an extending the straight portion and also extending the straight portions of the adjoining sides. Furthermore, a tabular silver halide grain forming nearly a round tabular grain due to further rounded corner is preferably employed.

In the present invention, regarding each edge forming the hexagon of a hexagonal tabular grain, not shorter than one and half of the edge is preferred to be substantially a straight line.

The silver halide grain employed in the present invention may have dislocation lines. The dislocation can be directly observed by a method employing, at low temperature, a transmission type electron microscope, described in, for example, J. F. Hamilton, Phot. Sci. Eng., Volume 57 (1967). Namely, silver halide grains carefully sampled from an emulsion so that no pressure is applied to cause the dislocation in the grain is placed on a mesh for an electron microscope observation, and is observed under a sample cooling state to minimize damages (print-out, etc.) due to an electron-beam. At this time, the greater the thickness of the grain becomes, the less an electron beam is transmitted. Thus by employing a high voltage type (not less than 200 kV for a grain having a thickness of 0.25 μm) electron microscope, clear observation can be carried out.

Being based on the grain photograph obtained by the method mentioned above, the position and number of dislocations in each grain can be obtained. The dislocation position in the silver halide grain employed in the present invention is preferably formed in the region of 0.58 L to 1.0

L from the center of the silver halide grain to the direction of the exterior surface, and is more preferably formed in the region of 0.80 L to 0.98 L. The direction of the dislocation line approximately shows the direction from the center to the exterior surface, but the dislocation line may be zigzagged.

In the present invention, the center of a silver halide grain is the center of a smallest circumcircle drawn for the cross section, which is obtained in the same method as described in the Inoue's and coworkers' Abstract described in Nihon Shashin Gakkai Koenyoshi-shu (Lecture Abstracts of Japan Photographic Society) pages 46 to 48, obtained by dispersing fine silver halide crystals into a methacryl resin, solidifying the resulting dispersion, and cutting the resulting solid into a ultra-thin slice employing a microtome, and by paying attention to slice samples having a maximum sectional area and a sectional area of not less than 90 percent of the maximum area. In the present invention, distance L from the center to the exterior surface is defined as a distance between the center and the point intersecting with the outer circumference of the grain when a straight line is drawn from the center of the above-mentioned circle to the direction of the exterior.

Regarding the number of dislocations of the silver halide grains employed in the present invention, grains having one or moredislocation account for preferably not less than 50 percent of the total grains (based on the number of grains) and the more ratio of the number of tabular grains having dislocation, the more preferable.

In the present invention, the grain diameter is the diameter of a circle having the same area as that of a grain projection image. The grain projection area can be obtained employing the sum of this grain area. The above data can be obtained by observing, with an electron microscope, a silver halide crystal sample in which crystals are distributed so that any crystal is overlapped with others.

The average projection area diameter of the tabular silver halide grain employed in the present invention is represented by the diameter of a circle having the same area as the above-mentioned grain projection area, and is preferably not less than 0.30 $\mu$m; more preferably between 0.30 and 5 $\mu$m; and most preferably between 0.40 and 2 $\mu$m.

The grain diameter is obtained by enlarging the above-mentioned grain 10,000 to 70,000 times employing an electron microscope and measuring the projection area on the print.

Furthermore, an average diameter ($\phi i$) is obtained by the following formula, wherein n represents the number of measured grains, and ni represents a grain frequency having the grain diameter $\phi i$.

Average diameter ($\phi i$)=$\Sigma nidi/n$ (the number of measured grains is randomly set at not less than 1,000.)

The thickness of a grain can be obtained by obliquely observing a sample. The preferred thickness of the tabular grain employed in the present invention is between 0.03 and 1.0 $\mu$m, and more preferably between 0.05 and 0.5 $\mu$m.

The ratio of the longest distance "a" between at least two of parallel twin planes in the silver halide grain of the present invention to the thickness "b" of the grain, (b/a), is preferably not less than 5, and the number ratio of the grains having the above-mentioned ratio of not less than 5 of the total is preferably not less than 50 percent.

The tabular silver halide grain employed in the present invention may has a uniform composition. However, a light-sensitive silver halide emulsion layer may be comprised of grains having a core/shell type structure comprising at least two layers with a substantially different halogen composition in the silver halide grain.

The silver halide grain employed in the present invention may be a so-called halogen conversion type grain. A halogen conversion amount is preferably between 0.2 and 2.0 mole percent of silver. The conversion may be carried out during physical ripening or after the completion of the physical ripening. As a halogen conversion method, an aqueous halogen solution or fine silver halide grains having less solubility product than the halogen composition on the grain surface prior to the halogen conversion are generally added. At the time, the fine grain size is preferably not more than 0.2 $\mu$m and more preferably between 0.02 and 0.1 $\mu$m.

The silver halide grain, employed in the present invention, is preferably grown in such a manner that silver halide is deposited on a seed crystal as a method described in, for example, Japanese Patent Publication Open to Public Inspection No. 60-138538.

To obtain the tabular silver halide grain emulsion employed in the present invention, a method of preparing a silver halide photographic emulsion by supplying an aqueous water-soluble silver salt solution and an aqueous water-soluble halide solution in the presence of a protective colloid is preferably employed, comprising:

(a) a process of forming nucleus grains having a silver iodide content of 0 to 5 mole percent, in which the pBr of a mother liquid is kept at 2.5 to −0.7, from the beginning of forming silver halide precipitates to not less than one half period;

(b) in succession to the above-mentioned nucleus grain forming process, a seed grain forming process in which a mother liquor comprises a silver halide solvent in a concentration of $10^{-5}$ to 2.0 mole per mole of silver halide to form substantially monodispersed spherical twin crystal grains, or in which the mother liquid is heated to 40 to 80° C. to form silver halide twin crystal seed grains; and (c) subsequently, a growing process of enlarging the seed grains by the addition of a water-soluble silver salt solution and water-soluble halide solution and/or fine silver halide grains.

The mother liquor herein is liquid substrate which is employed for preparing a silver halide emulsion (including a silver halide emulsion).

The silver halide grains formed in the above-mentioned grain forming process are twin crystal grains comprised of silver iodide having a concentration of 0 to 5 mole percent.

During the period of a seed grain forming process employed in the present invention, a water-soluble silver salt may be added to control ripening. The seed grain growing process is completed by controlling the pAg, pH, temperature, concentration of a silver halide solvent and composition of silver halide during precipitation of silver halide and Ostwald ripening, and the rate of addition of a silver salt and halide solution.

Furthermore, upon preparing a silver halide emulsion, a silver halide solvent known in the art, such as ammonia, thioether, thiourea, etc. may be present during the seed grain forming process and seed grain growth.

In order to prepare the tabular silver halide grains employed in the present invention, as conditions to grow the prepared seed grains, as described in, for example, Japanese Patent Publication Open to Public Inspection Nos. 51-39027, 55-142329, 58-113928, 54-48521, and 58-49938, a water-soluble silver salt solution and a water-soluble halide solution are added employing a double-jet method and a method may be employed in which the rate of addition is gradually varied in the range such that no new nucleus is formed in accordance with the grain growth and no Ostwald ripening occurs. As another condition to enlarge the seed grains, as is described in Item 88 of Abstract Collection of 1983 Annual Meeting of Japan Photographic Society, a method may be employed in which grains are enlarged by adding fine silver halide grains to be allowed to dissolve and recrystallize.

Upon growing grains, an aqueous silver nitrate solution and an aqueous halide solution may be added employing a double-jet method, but iodine may be supplied to a system in the form of silver iodide. The rate of addition is a rate at which a new nucleus is generated and no broadening of a size distribution occurs due to Ostwald ripening, that is, addition is preferably carried out in the 30 to 100% range of the rate of new nucleus formation.

Upon preparing the silver halide emulsion of the present invention, stirring conditions during preparation are extremely important. As a stirring device, the device disclosed in Japanese Patent Publication Open to Public Inspection No. 62-160128 is preferably employed in which an addition liquid nozzle is arranged, in a liquid, near a mother liquid sucking hole of the stirrer. Furthermore, in this case, the stirring rotation number is preferably set at 400 to 1,200 rpm.

The silver iodide content ratio and average silver iodide content ratio of silver halide grains employed in the present invention can be measured employing an EPMA method (Electron Probe Microanalyzer). In this method, a sample is prepared in which emulsion grains are well dispersed so that the grains are not in contact with each other, and an element analysis for a micro part is carried out employing an X-ray analysis utilizing an electron beam excitation generated by electron beam irradiation. Employing this method, the halogen composition of each grain can be determined by measuring characteristic X-ray intensities of silver and iodide radiated from each grain. With at least 100 grains, the average silver halide content ratio of each grain is obtained employing the EPMA method and the average silver iodide content ratio is then calculated.

In the production of the light-sensitive silver halide emulsion of the present invention, a seed grain emulsion is preferred, in which the total projection area of not less than 50 percent has at least two parallel twin planes, and the variation coefficient of the thickness of the above-mentioned seed grains and the variation coefficient of the longest distance between the twin planes of the above-mentioned seed grains are not less than 35 percent.

Although either the variation coefficient of the thickness of the seed grains or the variation coefficient of the longest distance between twin planes of the above-mentioned seed grains is adjusted to not more than 35 percent, it is difficult to adjust the distance between the twin planes after grain growth to not more than 35 percent. Therefore, both variation coefficients are preferably adjusted to not more than 35 percent.

Generally, it is considered that the twin plane is formed during nucleus formation. However, the above-mentioned fact may show that the twin plane is formed during grain growth.

Furthermore, during the grain forming process and/or grain growth process, the silver halide grains employed in the present invention may be subjected to incorporation of at least one metal ion selected from cadmium salts, zinc salts, thallium salts, iridium salts (including the complexes), and iron salts (including the complexes) in the grain interior and/or the grain surface layer, and further may be subjected to formation of reduction sensitization nuclei in the grain interior and/or the grain surface, while being placed in reduction environment.

Furthermore, the action of the reducing agent added during grain forming process is preferably retarded or terminated by the addition of an oxidizing agent such as hydrogen peroxide (aqueous solution) and addition compounds thereof, peroxo acid salts, ozone, $I_2$, etc.

The oxidizing agent is optionally added during a period from the silver halide grain formation to the chemical sensitization process.

The silver halide emulsion of the silver halide light-sensitive photographic material of the present invention may be subjected to removal of unnecessary salts after the completion of silver halide grain growth or retention of the salts. The removal of the above-mentioned salts can be carried out employing methods described in Research Disclosure (hereinafter referred to as RD) Item 17643 Section II.

Further, the silver halide emulsion layer employed in the present invention may comprise various shapes of grains as far as the effects of the present invention are not degraded.

The silver halide emulsion of the present invention may be added with various antifoggants and stabilizers, which specifically include tetraazaindenes, azoles, benzothiazolium salts, nitroindazoles, nitrobenzimidazoles, chlorobenzimidazoles, bromobenzimidazoles, mercaptothiazoles, mercaptobenzimidazoles, aminotriazoles, benzotriazoles, nitrobenzotriazoles, mercaptotetrazoles, mercaptopyrimidines, mercaptotriadines, thioketo compounds, further, benzenethiosulfinic acid, benzenesulfinic acid, benezenesulfonic acid amide, hydroquinone derivatives, aminophenol derivatives, gallic acid derivatives, ascorbic acid derivatives.

Furthermore, the silver halide emulsion layer employed in the present invention may comprise various shapes of grains as far as the effects of the present invention are not degraded.

The silver halide light-sensitive material of the present invention may be addided with various photographic additives. Additives known in the art include compounds described in, for example, Research Disclosure (RD) Items 17643 (December 1978), 18716 (November 1979), and 308119 (December 1989). Types and cited pages of compounds described in these three RDs are shown below.

TABLE 1

| | RD-17643 | | RD-18716 | | RD-308119 | |
|---|---|---|---|---|---|---|
| Additive | Page | Section | Page | Section | Page | Section |
| Chemical Sensitizer | 23 | III | 648 upper right | | 996 | III |
| Sensitizing Dye | 23 | IV | 648–649 | | 996–998 | IVA |
| Desensitizing Dye | 23 | IV | | | 998 | IVB |
| Dye | 25–26 | VIII | 649–650 | | 1003 | VIII |
| Development Accelerator | 29 | XXI | 648 upper right | | | |
| Antifoggant and Stabilizer | 24 | IV | 649 upper right | | 1006–1007 | VI |
| Optical Brightening | 24 | V | | | 998 | V |

TABLE 1-continued

| | RD-17643 | | RD-18716 | | RD-308119 | |
|---|---|---|---|---|---|---|
| Additive | Page | Section | Page | Section | Page | Section |
| Agent | | | | | | |
| Hardener | 26 | X | 651 left | | 1004–1005 | X |
| Surface Active Agent | 26–27 | XI | 650 right | | 1005–1006 | XI |
| Antistatic Agent | 27 | XII | 650 right | | 1006–1007 | XIII |
| Plasticizer | 27 | XII | 650 right | | 1006 | XII |
| Slip Agent | 27 | XII | | | | |
| Matting Agent | 28 | XVI | 650 right | | 1008–1009 | XVI |
| Binder | 26 | XXII | | | 1003–1004 | IX |
| Support | 28 | XVII | | | 1009 | XVII |

Further, the silver halide emulsion of the present invention may comprise a developing agent, for example, aminophenol, ascorbic acid, pyrocatechol, hydroquinone, phenylenediamine, 3-pyrazolidone, etc. in the emulsion layer or the other layers.

The support employed for the silver halide light-sensitive material of the present invention includes, for example, those described on page 28 of RD Item 17643 and page 10009 of RD Item 308119. Suitable supports include polyethylene terephthalate and the like. The surfaces of these supports may be subjected to arrangement of a subbing layer and treatment of corona discharging and ultraviolet-ray irradiation in order to improve the adhesion of a coating layer.

EXAMPLES

Examples of the present invention are described below. However, the present invention is not limited to these examples.

Example 1 (Synthesis of Compound 4)

1. Synthesis of 1,2-dimetyl-5-morpholinosulfonyl-3-(2,2,2-trifluoroethyl)benzimidazolium-trifluoromethanesulfonate (Intermediate (1))

In 20 ml of a toluene solution, 5.9 g of 1,2-dimethyl-5-morpholinosulfonylbenzimidazole synthesized by a method described in Japanese Patent Publication No. 43-10252, end 6.5 g of 2,2,2-trifluoroethyl-trifluoromethanesulfonate were heated in reflux for 24 hours. After the resulting mixture was allowed to cool to room temperature, the supernatant was separated; to the reaction mixture was added an ethyl acetate solution and dispersed, and the product was collected by filtration and washed to obtain 7.2 g of a quartenary salt.

2. Synthesis of 3-(2-(N-acetylanilino)ethenyl)-1-ethenyl-5-trifluoromethyl-3-benzimidazolio) propanesulfonate (Intermediate (2))

To 60 ml of methanol, in which 5.3 g of 1-(2-chloroethyl)-2-methyl-5-trifluoromethylbenzimidazole synthesized by a method described in U.S. Pat. No. 3,794,498 was dissolved, 10 g of an aqueous 20% sodium hydroxide solution was added, and the resulting mixture was heated under reflux for 40 minutes. Deposited sodium chloride was removed by filtration and the filtrate was concentrated under reduced pressure; the residue was added with water and crystallized. The resulting crystals were collected by filtration, washed and dried to obtain 4.4 g of an N-ethenyl compound. The ethenyl compound of 2.3 g and 2.6 g of 1,3-propanesultone were mixed and added with 10 ml of a sulfolane solvent, and the resulting mixture was heated at 120° C. for 20 minutes. After cooling to room temperature, the deposit was collected by filtration and washed employing acetone to obtain 3.6 g of a quaternary salt.

To 2 ml of m-cresol, 2.8 g of the quaternary salt and 1.9 g of diphenylformamidine were added and stirred at 140° C. for 4 hours. The reaction solution was dispersed by the addition of 30 ml of acetone and collected by filtration. The resulting product was washed with acetone to furnish yellow crystals. The resulting crude crystals were dispersed into 20 ml of acetic anhydride and added with 2.4 g of triethylamine. The resulting mixture was heated and allowed to react at 90 to 100° C. for 15 minutes. After cooling to room temperature, the reaction mixture was diluted by the addition of 30 ml of acetone, and the crystallized deposit was collected by filtration, washed with acetone, and dried. Thereafter, the crude crystals were recrystallized employing methanol to obtain 2.6 g of yellow crystals.

3. Target compound (Synthesis of Compound 4)

With 5 g of dimethyl sulfoxide (hereinafter referred to as DMSO), 2.6 g of the above-mentioned Intermediate (1) and 2.5 g of Intermediate (2) were mixed; the resulting mixture was added with 1.6 g of 1,8-diazabicyclo[5,4,0]undeca-7-ene (DBU), and stirred at 100° C. for 5 minutes. After cooling to room temperature, the resulting solution was precipitated with the addition of 15 ml of ethyl acetate. The supernatant was separated by decantation and the residual precipitate was dispersed by the addition of ethanol and collected by filtration.

The resulting crude crystals were recrystallized employing a mixture solution consisting of methanol and dichloromethane to furnish 1.4 g of orange crystals.

The obtained crystals were identified to be the target compound (Compound 4) employing 1H-NMR spectra and mass spectra. The absorption maximum wavelength of the Compound 4 was 506 nm ($\epsilon_{max}$=18.1×10$^4$).

Spectra measurement results of 1H-NMR (measurement solvent: DMSO-d-6) are described below.

Measured peaks: 1.48–1.44 (3H, t, J=5.3 Hz), 2.14–2.07 (2H, m), 2.61–2.58 (2H, t, J=5.3 Hz), 2.89 (4H, s), 3.65–3.63 (4H, t, J=3.5 Hz) , 4.49–4.39 (4H, m), 5.50–5.44(2H, q, J=6.6 Hz) , 5.95–5.93 (2H, d, J=5.5 Hz), 6.08–6.02 (2H, q, J=10.1, 11.5 Hz), 6.19–6.16 (1H, d, J=10.2 Hz), 7.21–7.15 (1H, r, J=6.1, 11.6), 7.71–7.685 (2H, q, J=0.8, 6.5 Hz), 7.74–7.72 (1H, d, J=6.1 Hz), 7.85–7.83 (1H, d, J=6.3 Hz), 8.03 (1H, s), 8.10–8.03 (1H, t, J=9.9 Hz), 8.26 (1H, s)

Example 2 (Synthesis of Compound 8)

1. 3-(2-(2-(N-acetylanilino)ethenyl)-1-methyl-5-trifluoromethyl-3-benzimidazolio)propanesulfonate (Synthesis of Intermediate (3))

4.0 g of 1,2-dimethyl-5-trifluoromethylbenzimidazole synthesized by a method described in U.S. Pat. No. 3,794,498, and 2.6 g of 1,3-propanesultone were mixed and were added with 20 ml of a sulpholane solvent and the resulting mixture was heated at 120° C. for 20 minutes. The reaction product was dispersed by the addition of 20 ml of acetone, and crystals were deposited. The deposit was collected by filtration and washed to obtain 5.8 g of a quaternary salt.

To 10 ml of m-cresol, 3.3 g of the quaternary salt and 2.2 g of diphenylformamidine were added and the resulting mixture was stirred at 120° C. for 4 hours. The reacted solution was added with 40 ml of acetone, was dispersed, deposited upon crystallization, collected by filtration, and washed by acetone to furnish yellow crystals. The crude crystals were dispersed into 20 ml of acetic anhydride and added with 2.4 g of triethylamine and the resulting mixture was heated at 90 to 100° C. for 15 minutes. After cooling to room temperature, the resulting solution was dispersed by the addition of 30 ml of acetone, and the deposit was collected by filtration and washed by acetone and dried. The crude crystals were recrystallized employing methanol to furnish 3.1 g of yellow crystals.

2. Synthesis of Target Compound (Compound 8)

With 5 g of dimethyl sulfoxide (hereinafter referred to as DMSO), 1.5 g of 1-ethyl-2-methyl-5-morpholinosulfonyl-3-(2,2,2-trifluoroethyl)benzimidazolium-trifluoromethanesufonate synthesized employing the same method as for Intermediate (1) of Example 1, and 2.4 g of the above-mentioned Intermediate (3) were mixed, and the resulting mixture was added with 1.6 g of 1,8-diazabicyclo [5,4,0]undeca-7-ene (DBU), and stirred at 100° C. for 15 minutes. After cooling to room temperature, the resulting solution was precipitated with the addition of 15 ml of ethyl acetate. The supernatant was discarded and the residual precipitate was dispersed by the addition of ethanol and collected by filtration. The resulting crude crystals were recrystallized employing a mixture solution consisting of methanol and dichloromethane to obtain 1.5 g of orange crystals.

The obtained crystals were identified to be the target compound (Compound 8) employing 1H-NMR spectra and mass spectra.

The absorption maximum of the Compound 8 in methanol was at a wavelength of 502 nm ($\epsilon_{max}$=16.5×10$^4$).

Spectra measurement results of 1H-NMR (measurement solvent: DMSO-d-6) are described below.

Measured peaks: 1.49–1.45 (3H, t, J=5.3 Hz), 2.13–2.05 (2H, m), 2.56–2.53 (2H, t, J=5.3 Hz), 2.90–2.89 (4H d, J=2.9 Hz), 3.65–3.63 (4H, t, J=3.5 Hz), 4.04 (3H, s), 4.45–4.40 (2H, q, J=5.1 Hz), 4.54–4.51 ((2H, d, J=5.3 Hz), 5.50–5.43 (2H, q, J=6.6 Hz), 5.95–5.92 (1H, d, J=9.9 Hz), 6.08–6.02 (2H, q, J=10.1, 11.5 Hz), 6.19–6.16 (1H, d, J=10.2 Hz), 6.18–6.15 (1H, d, J=10.2 Hz), 7.66–7.64 (1H, q, J=0.8, 6.3 Hz), 7.76–7.73 (1H, d, J=6.3 Hz), 7.79–7.77 (2H, d, J=6.3 Hz), 7.91–7.89 (1H, d, J=6.3 Hz)), 7.95 (1H, s), 8.11–8.04 (1H, t, J=10.1 Hz), 8.28 (1H, s)

Example 3 (Synthesis of Compound 10)

1. Synthesis of 2-(1,2-dimetyl-5-morpholinosulfonyl-3-benximidazolio) acetic acid (Intermediate (4))

In 20 ml of a toluene solution, 5.9 g of 1,2-dimethyl-5-morpholinosulfonylbenzimidazole synthesized by a method described in Japanese Patent Publication No. 43-10252, and 3.1 g of bromoacetic acid were heated in reflux for 24 hours. After cooling to room temperature, the supernatant was discarded by decantation; the reaction product was added with an ethyl acetate solution, dispersed, collected by filtration, washed, and dried to furnish 5.9 g of a quartenary salt.

2. With 6 g of dimethyl sulfoxide (hereinafter referred to as DMSO), 2.4 g of Intermediate (3) in Example 2 and 2.1 g of the above-mentioned Intermediate (4) were mixed, and the resulting mixture was added with 1.6 g of 1,8-diazabicyclo [5,4,0]undeca-7-ene (DBU), and stirred at 100° C. for 15 minutes. After cooling to room temperature, the resulting solution was precipitated with the addition of 18 ml of ethyl acetate. The supernatant was separated employing decantation and the residual precipitate was dissolved in 12 ml of ethanol and precipitated again by the addition of ethyl acetate of a 10 times volume. The precipitate was dissolved in 50 ml of ethanol and crystallized by the addition of 10 ml of an ethanol solution containing 0.7 g of potassium acetate. The deposited crystals were collected by filtration and washed with ethanol. The crude crystals were recrystallized employing methanol to obtain 1.4 g of orange crystals.

The obtained crystals were identified to be the target compound (Compound 10) employing 1H-NMR spectra and mass spectra.

The absorption maximum wavelength of the Compound 10 in methanol was at a wavelength of 502 nm ($\epsilon_{max}$=15.8×10$^4$).

Spectra measurement results of 1H-NMR (measurement solvent: DMSO-d-6) are described below.

Measurement peaks: 2.07–2.03 (2H, t, J=5.3 Hz), 2.58–2.55 (2H, t, J=5.5 Hz), 2.89 (4H, s), 3.63 (4H, s), 3.95 (3H, s), 4.44–4.40 (2H, t, J=5.3 Hz), 4.63 ((2H, s), 5.82–5.79 (1H, d, J=9.9 Hz), 5.90–5.87 (1H, d, J=10.1 Hz), 7.63–7.60 (2H, q, J=2.6 Hz, 6.3 H), 7.32 (1H, s), 7.79–7.74 (2H, t, J=6.6 Hz), 8.08 (1H, s), 8.19–8.12 (1H, t, J=10.1 Hz)

Example 4 and Example 5 (Synthesis of Compounds 11 and 17)

Compounds 11 and 17 were prepared in the same synthesis as in Example 1.

The absorption maximum of the Compound 11 in methanol was at a wavelength of 503 nm ($\epsilon_{max}$=16.9×10$^4$) .

The absorption maximum of the Compound 17 in methanol was at a wavelength of 499 nm ($\epsilon_{max}$=15.8×10$^4$).

Example 6

(Preparation of Seed Emulsion)

The seed emulsion having two parallel twin planes was prepared employing the method shown below.

| | |
|---|---|
| (Liquid E-5) | |
| Deionized alkali-treated gelatin (average molecular weight: 15,000) | 244.0 g |
| Potassium bromide | 156.6 g |
| 10% methanol solution of $HO(CH_2CH_2O)_m(CH(CH_3)CH_2O)_{19.8}(CH_2CH_2O)_nH$ (m + n = 9.77) | 0.48 mL |
| Water to make | 34.0 L |
| (Liquid F-5) | |
| Silver nitrate | 1,200 g |
| Water to make | 3,716 mL |
| (Liquid G-5) | |
| Deionized alkali-treated gelatin (average molecular weight: 15,000) | 31.6 g |
| Potassium bromide | 906.0 g |
| Water to make | 4 L |
| (Liquid H-5) | |
| Aqueous ammonia (28%) | 299 mL |
| (Liquid I-5) | |
| Water | 8 L |
| (Liquid J-5) | |
| Ossein gelatin | 400.0 g |
| Water to make | 4832 mL |
| (Liquid K-5) | |
| Potassium bromide | 69.2 g |
| Water to make | 386 mL |
| (Liquid L-5) | |
| Aqueous 56 weight percent acetic acid solution | 1,000 mL |

To Solution E-5 which was vigorously stirred at 30° C. employing a stirring device described in Japanese Patent Publication Open to Public Inspection No. 62-160128, Solution K-5 was added, Solutions F-5 and C-5 were then added to the resulting mixture for two minutes employing a double-jet method to form silver halide nuclei. Subsequently, after adding Solution J-5, the resulting mixture was heated to 68° C. in 41 minutes and added with Solution H-5 followed by ripening for seven minutes. Thereafter, Solution I-5 was added and one minute later, the pH was adjusted to 4.7 employing Liquid L-5, immediately followed by salt removal. This seed emulsion was observed employing an electron microscope and it was found that the resulting emulsion was a monodispersed emulsion comprised of grains with two parallel twin planes, having an average grain diameter (diameter of a circle having the same area as the grain projection area) of 0.31 μm and a grain diameter distribution width of 16 percent.

(Preparation of Emulsion Em-1)

Emulsion Em-1 was prepared employing the spherical type seed emulsion and solutions shown below.

| | |
|---|---|
| (Liquid H-6) | |
| Ossein gelatin | 223.6 g |
| 10% methanol solution of $HO(CH_2CH_2O)_m(CH(CH_3)CH_2O)_{19.8}(CH_2CH_2O)_nH$ (m + n = 9.77) | 3.6 mL |
| Seed emulsion | equivalent to 0.774 mole |
| Water to make | 5,904 mL |
| (Liquid I-6) | |
| Aqueous 3.5N silver nitrate solution | 6,490 mL |
| (Liquid J-6) | |
| Aqueous 3.5N potassium bromide solution | 7,500 mL |
| (Liquid K-6) | |
| Fine grain emulsion SMC-1 consisting of 3.0 weight weight percent gelatin and fine silver iodide grains (average diameter of 0.05 μm) (preparation of fine silver iodide grain emulsion is shown below) | required amount |
| (Liquid L-6) | |
| Aqueous 1.75N potassium bromide solution | required amount |
| (Liquid M-6) | |
| Aqueous 56 weight percent acetic acid solution | required amount |
| (Liquid N-6) | |
| Aqueous 3.5N potassium bromide solution | 500 mL |

Note: "required amount" mentioned above is an added amount to adjust the pAg and pH of the mixture in a reaction vessel mentioned below to 9.8 and 5.8, respectively.

< <Preparation of Fine Silver Iodide Grain Emulsion> >

To 5 liters of an aqueous 6.0 weight percent gelatin solution containing 0.06 mole of potassium iodide under vigorous agitation, 2 liters of an aqueous 7.06 mole silver nitrate solution and 2 liters of an aqueous 7.06 mole potassium iodide solution were added during the period of 10 minutes. During the period, the pH was adjusted to 2.0 using nitric acid and the temperature was controlled at 40° C. After preparing grains, the pH was adjusted to 5.0 using an aqueous sodium carbonate solution. The average grain diameter of the resulting fine silver iodide grains was 0.05 μm. The resulting fine silver iodide grain emulsion was termed SMC-1.

Liquid H-6 was put into a reaction vessel and added, under vigorous stirring, with Liquids I-6, J-6, and K-6 employing a double-jet mixing methods in accordance with the combinations shown in Table 2 to grow a seed crystal and a core/shell type silver halide emulsion was prepared.

Here, the addition rate of Liquids I-6, J-6, and K-6 was acceleratedly varied in consideration of a critical growth rate so that neither fine grain formation other than the seed grains under growth nor widening of the grain size distribution due to Ostwald ripening occurs.

First, the grain growth was conducted in such a manner that a first addition was carried out, while keeping the temperature and pAg of the solution in a reaction vessel at 75° C. and 8.8, respectively; thereafter, within 15 minutes, the temperature of the solution in the vessel was lowered to 60° C.; Liquid N-6 was added for 4 minutes; the amount of Liquid K-6 which was equivalent to two percent of the total amount of employed silver was added; and a second addition was then carried out. The second addition was carried out, while controlling the temperature, pAg, and pH of the solution in the reaction vessel at 60° C., 9.8, and 5.8, respectively. In order to control the pAg and pH, Liquids L-6 and M-7 were optimally added.

After completing the grain growth, desalting was carried out according to the method described in Japanese Patent Publication Open to Public Inspection No. 5-72658. Thereafter, gelatin was added and redispersed to obtain an emulsion with a pAg of 8.06 and a pH of 5.8 at 40° C.

The silver halide grains in the resulting emulsion was observed employing an electron microscope. It was found that the grains were those of hexagonal tabular monodispersed silver halide grains having an average grain diameter of 1.30 μm, a grain diameter distribution of 17 percent, and an average aspect ratio of 8.0. Furthermore, this silver halide tabular grain had dislocation lines at the fringe part

TABLE 2

| Added Solution | Addition Time (min.) | Added Silver Amount (%) | Silver Iodide Content (mol %) | Addition |
|---|---|---|---|---|
| | 0.00 | 0.0 | 8.5 | First |
| I-6, | 23.13 | 5.0 | 8.5 | Addition |
| J-6, | 41.45 | 10.0 | 8.5 | |
| K-6 | 70.27 | 20.0 | 8.5 | |
| | 110.56 | 40.0 | 8.5 | |
| | 142.89 | 66.0 | 8.5 | |
| I-6, | 161.89 | 68.0 | 7.0 | Second |
| J-6, | 182.73 | 80.0 | 7.0 | Additon |
| K-6 | 191.34 | 90.0 | 7.0 | |
| | 199.64 | 100.0 | 7.0 | |

The resulting emulsion Em-1 was subdivided to prepare Emulsions A through M, employing the method described below.

After heating the resulting emulsion to 58° C., $4.3\times10^{-4}$ mole/mole Ag of the dye shown in Table 3 was added. After 20 minutes, $5\times10^{-6}$ mole/mole Ag of sodium thiosulfate pentahydride, $3.2\times10^{-6}$ mole/mole Ag of chloroauric acid, $3.5\times10^{-4}$ mole/mole Ag of potassium thiocyanate, $2.5\times10^{-6}$ mole/mole Ag of triphenylphosphine selenide were added, followed by ripening so that the sensitivity at an exposure time of 1/100 second reached an optimum value. At the time of completing the ripening, stabilizer ST-1 and antifoggant AF-1 were added, followed by lowering the temperature to gel the resulting emulsion upon cooling and to prepare each emulsion.

To each of the resulting emulsions, magenta coupler M-1 dissolved in ethyl acetate and tricresyl phosphate (OIL-1), a dispersing aid (SU-1), a dispersion prepared by emulsify dispersing into an aqueous gelatin-containing solution, a wetting agent (SU-2) and hardeners (H-1 and H-2) were added to prepare a coating composition. Each of the coating compositions was coated onto a subbed cellulose triacetate support and dried to prepare Samples 101 through 114.

The method to prepare a monodispersed emulsion layer coated sample is shown below.

| <Coating Formula> | | |
|---|---|---|
| Order from the support side | | |
| First layer: green-sensitive silver halide emulsion layer | | |
| Emulsion | coated silver amount | 1.5 g/m$^2$ |
| Magenta coupler (M-1) | | 0.33 g/m$^2$ |
| Tricresyl phosphate (OIL-1) | | 0.50 g/m$^2$ |
| Gelatin | | 3.5 g/m$^2$ |
| Second layer: surface protective layer | | |
| PM-1 | | 0.15 g/m$^2$ |
| PM-2 | | 0.04 g/m$^2$ |
| Gelatin | | 0.65 g/m$^2$ |

Employing coating samples prepared as mentioned above, the spectral absorption maximum wavelength of a sensitizing dye in a light-sensitive material was measured as follows.

< <Measurement of Spectral Reflection Absorption Maximum Wavelength of Sensitizing Dye in Light-sensitive Material> >

An unexposed coating sample was placed in a U-3410 type automatic recording spectrophotometer (manufactured by Hitachi, Ltd.) with a 4.6 cm integrating sphere and the spectral reflection absorption spectrum of each sample was measured.

Next, a sample other than that employed for the measurement of the spectral reflection absorption maximum wavelength was subjected to wedge exposure through a Toshiba

ST-1

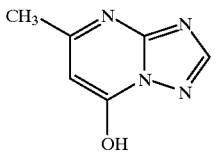

AF-1

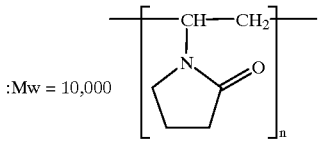

:Mw = 10,000

M-1

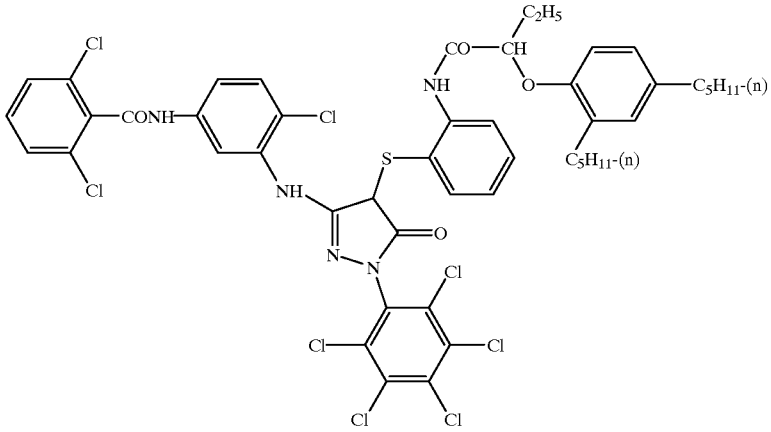

SU-1

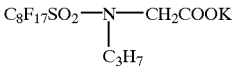

SU-2

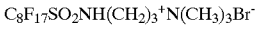

H-1

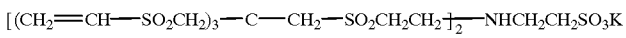

H-2

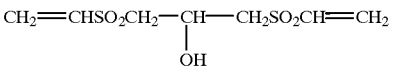

PM-1

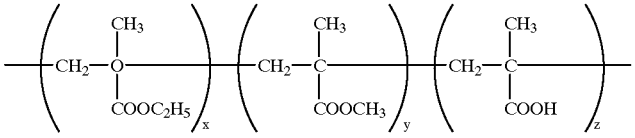

x:y:z = 3:3:4

PM-2

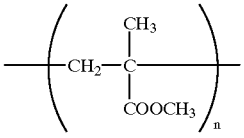

glass filter Y-48 employing a light source of 5400 K and each of the exposed samples was subjected to photographic processing according to the processing steps mentioned below, and sensitivity, fog, and storage stability under the conditions of high temperature and humidity were evaluated.

< <Sensitivity> >

The sensitivity of each Sample was obtained as the reciprocal of an exposure amount to generate a green optical density of fog plus 0.15 and expressed as a relative value when the sensitivity of Sample No. 101 was 100.

< <Fog> >

Fog was expressed as the minimum density of the characteristic curve obtained by measuring the green density of a processed Sample.

< <Storage Stability under the condition of high temperature and high humidity (Δfog)> >

In order to evaluate fog formation during storage, a Sample was allowed to stand under the condition of relative humidity of 80% at 23° C. for 24 hours, then put into a sealed plastic can, and aged at 40° C. for 5 days. The resulting Sample was subjected to photographic processing shown below together with a corresponding Sample stored in a refrigerator, and then, the difference between minimum densities on each of the obtained characteristic curves was measured as an increase of fog during storage. Table 3 shows the results.

Photographic Processing

| Processing Step | Processing Time | Processing Temperature | Replenishment Rate* |
|---|---|---|---|
| Color Development | 3 minutes 15 seconds | 38 ± 0.3° C. | 780 cc |
| Bleaching | 45 seconds | 38 ± 2.0° C. | 150 cc |
| Fixing | 1 minute 30 seconds | 38 ± 2.0° C. | 830 cc |
| Stabilizing | 60 seconds | 38 ± 5.0° C. | 830 cc |
| Drying | 1 minute | 55 ± 5.0° C. | — |

*Replenishment rate is a amount per $m^2$ of a light-sensitive material.

A color developer, a bleaching solution, a fixer and stabilizer, including their replenishers shown below were employed.

| Color Developer | |
|---|---|
| Water | 800 cc |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate salt | 2.5 g |
| Sodium chloride | 0.6 g |
| 4-Amino-3-methyl-N-ethyl-N-(β-hydroxyethyl)aniline sulfate salt | 4.5 g |
| Diethylenetriaminepentaacetic acid | 3.9 g |
| Potassium hydroxide | 1.2 g |
| Water to make | 1 liter |

The pH is adjusted to 10.06 employing sodium hydroxide or 20% sulfuric acid.

| Color Developer Replenisher | |
|---|---|
| Water | 800 cc |
| Potassium carbonate | 35 g |
| Sodium hydrogencarbonate | 3 g |
| Potassium sulfite | 5.0 g |
| Sodium bromide | 0.4 g |
| Hydroxylamine sulfate salt | 3.1 g |
| 4-Amino-3-methyl-N-ethyl-N-(β-hydroxyethyl)aniline sulfate salt | 6.3 g |
| Potassium hydroxide | 2.0 g |
| Diethylenetriaminepentaacetic acid | 3.0 g |
| Water to make | 1 L |

The pH is adjusted to 10.18 employing sodium hydroxide or 20% sulfuric acid.

| Bleach Solution | |
|---|---|
| Water | 700 cc |
| 1,3-diaminopropanetetraferric (III) acetate-ammonium | 125 g |
| Ethylenediaminetetraacetic acid | 2 g |
| Sodium nitrate | 40 g |
| Ammonium bromide | 150 g |
| Glacial acetic acid | 40 g |
| Water to make | 1 L |

The pH is adjusted to 4.4 employing an aqueous ammonia or glacial acetic acid.

| Bleach Replenisher | |
|---|---|
| Water | 700 cc |
| 1,3-diaminopropanetetraferricacetate (III)-ammonium | 175 g |
| Ethylenediaminetetraacetic acid | 2 g |
| Sodium nitrate | 50 g |
| Ammonium bromide | 200 g |
| Glacial acetic acid | 56 g |

The pH is adjusted to 4.4 employing an aqueous ammonia or glacial acetic acid, and water is then added to make 1 liter.

| Fixer | |
|---|---|
| Water | 800 cc |
| Ammonium thiocyanate | 120 g |
| Ammonium thiosulfate | 150 g |
| Sodium sulfite | 15 g |
| Ethylenediaminetertaacetic acid | 2 g |

The pH is adjusted to 6.2 employing aqueous ammonia or glacial acetic acid and water is then added to male 1 liter.

| Fixer Replenisher | |
|---|---|
| Water | 800 cc |
| Ammonium thiocyanate | 150 g |
| Ammonium thiosulfate | 180 g |
| Sodium sulfite | 20 g |
| Ethylenediaminetertaacetic acid | 2 g |

The pH is adjusted to 6.5 employing aqueous ammonia or glacial acetic acid and water is then added to male 1 liter.

| Stabilizer and Stabilizer Replenisher | |
|---|---|
| Water | 900 cc |
| p-Octylphenylpolyoxyethylene ether (n = 10) | 2.0 g |
| Dimethylolurea | 0.5 g |
| Hexamethylenetetramine | 0.2 g |
| 1,2-Benzoisothiazoline-3-one | 0.1 g |
| Siloxane (L-77 manufactured by UCC) | 0.1 g |
| Aqueous ammonia | 0.5 cc |
| Water to make | 1 L |

The pH is then adjusted to 8.5 employing aqueous ammonia or 50% sulfuric acid.

As is clearly seen in Table 3, as compared to Comparative Compound 1 and Comparative Compounds 3 through 5, Compounds of the present invention can achieve the decrease in fog and the increase in sensitivity. Furthermore, it is found that the fog during storage is decreased compared to Comparative Compounds.

It is found that Comparative Compound 2 in which a trifluoromethyl group is substituted to the position adjacent to a sulfamoyl group exhibits excellent photographic properties in improvements of fog and storage stability under the condition of high temperature and humidity, but the sensitivity is remarkably inferior to the dyes of the present invention.

TABLE 3

| Sample No. | Emulsion No. | Sensitizing Dye (SD) | λmax (nm) in Photographic Material | Fog | Sensitivity | Storage Stability | Remarks |
|---|---|---|---|---|---|---|---|
| 101 | A | Comparative Compound 1 | 534 | 0.20 | 100 | 0.27 | Comparative |
| 102 | B | Comparative Compound 2 | 546 | 0.14 | 82 | 0.08 | Comparative |
| 103 | C | Comparative Compound 3 | 530 | 0.16 | 74 | 0.14 | Comparative |
| 104 | D | Comparative Compound 4 | 541 | 0.27 | 86 | 0.37 | Comparative |
| 105 | E | Comparative Compound 5 | 545 | 0.15 | 88 | 0.10 | Comparative |
| 106 | F | Exemplified Compound 1 | 532 | 0.15 | 104 | 0.09 | Inventive |
| 107 | G | Exemplified Compound 3 | 534 | 0.14 | 102 | 0.08 | Inventive |
| 108 | H | Exemplified Compound 5 | 535 | 0.14 | 105 | 0.07 | Inventive |
| 109 | I | Exemplified Compound 7 | 538 | 0.14 | 108 | 0.08 | Inventive |
| 111 | J | Exemplified Compound 10 | 530 | 0.15 | 102 | 0.09 | Inventive |
| 112 | K | Exemplified Compound 11 | 537 | 0.14 | 109 | 0.08 | Inventive |
| 113 | L | Exemplified Compound 15 | 534 | 0.15 | 103 | 0.09 | Inventive |
| 114 | M | Exemplified Compound 18 | 533 | 0.14 | 103 | 0.08 | Inventive |

Comparative Compound-1

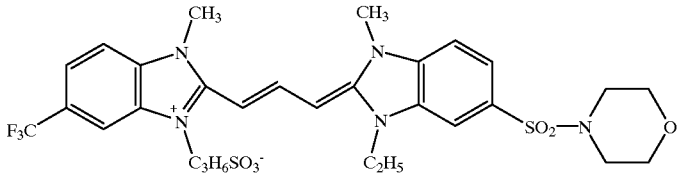

-continued

Comparative Compound-2

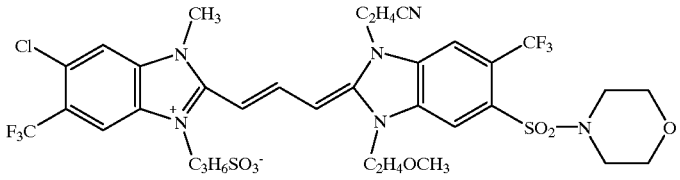

Japanese Patent Application No. 8-022446 No. 1-24

Comparative Compound-3

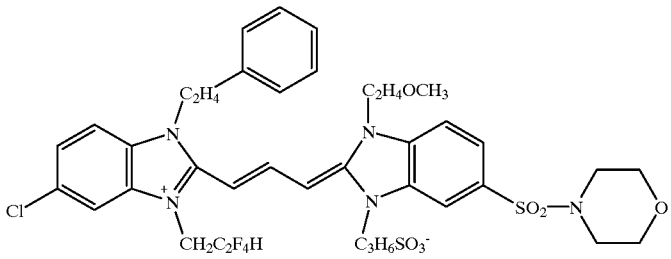

Japanese Patent Publication
Open to Public Inspection No. 59-181338 No. 15

Comparative Compound-4

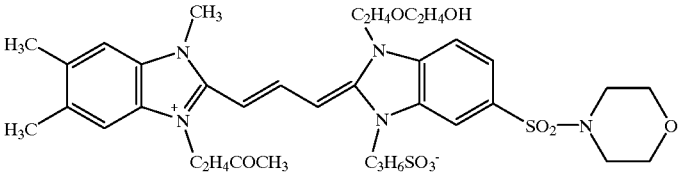

Japanese Patent Publication
Open to Public Inspection No. 6-118588 No. D-53

Comparative Compound-5

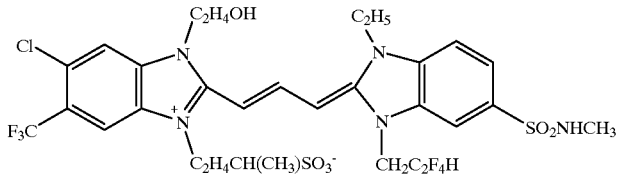

Japanese Patent Publication
Open to Public Inspection No. 6-266038 No. S-14

In the same manner as Example 6, monodispersed tabular silver iodobromide grain emulsion Em-2 (surface iodine= 6.84 percent) was prepared which had an average grain diameter of 0.73 $\mu$m and an aspect ratio of 7.42. Em-2 was subdivided to prepare Emulsions N through P employing the method shown below.

Each emulsion was heated to 60° C. and added with $2.5\times10^{-4}$ mole/mole Ag of a sensitizing dye SD shown in Table 4, kept at the same temperature for 30 minutes to proceed with dye adsorption, allowed to lower the temperature, chilled and gelled to furnish each emulsion. Each of the resulting emulsions was melted again, put into a 10 mm square cell, and while keeping the emulsion at 40° C., the reflection absorption spectrum was measured employing a U-3410 type auto-recording spectrophotometer (manufactured by Hitachi, Ltd.) on which a 4.6 cm integrating sphere was mounted. FIG. 1 shows measured spectra.

TABLE 4

| Emulsion No. | Sensitizing Dye (SD) | Remarks |
|---|---|---|
| N | 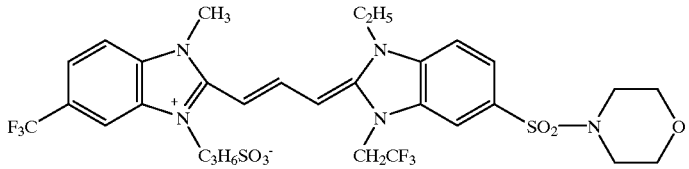 | Present Invention Compound No. 8 |
| O | 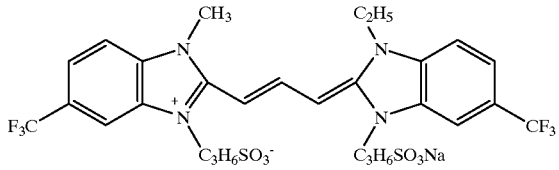 | Comparative Compound 6 Dye described in Japanese Patent Publication Open to Public Inspection No. 5-88293 |
| P | 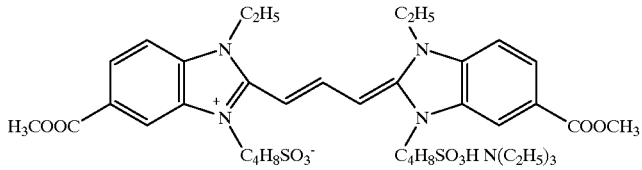 | Comparative Compound 7 |

FIG. 1 shows reflection absorption spectra of Emulsion Sample No. N of the present invention (Compound (8) of the present invention), Comparative Emulsion Sample No. O (Comparative Compound 6), Comparative Emulsion Sample No. P (Comparative Compound 7) and Emulsion Sample to which no sensitizing dye is added (Blank). According to the spectral reflection absorption measurement results of each Sample, it is found that Comparative Compound 6 exhibits a shorter maximum sensitization wavelength, approximately at about 545 nm, than that of the conventional benzimidazolocarbocyanine dye (Comparative Compound 7) known in the art, and on the other hand, Compound 8 of the present invention exhibits the shorter wavelength than that and shows the maximum spectral sensitization wavelength peak at 530 nm. As a result, it is found that the spectral absorption properties are optimum for the improvement in color reproduction.

What is claimed is:

1. A silver halide emulsion comprising a compound represented by the following formula (1) or (2):

formula (1)

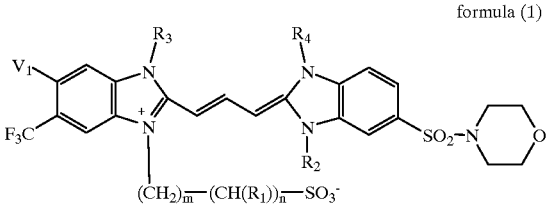

formula (2)

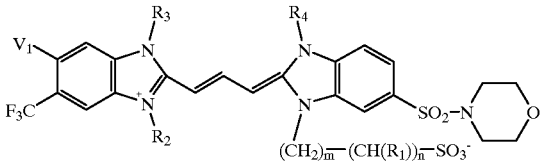

wherein $R_1$ represents a lower alkyl group, an aryl group or a 5- to 7-membered heterocyclic ring containing an oxygen atom, a sulfur atom a nitrogen atom, or its condensed ring; $R_2$ represents a methyl group or an ethyl group, each of which is substituted within an electron-attractive group; $R_3$ represents a methyl group or an ethenyl group; $R_4$ represents a methyl group, an ethyl group or an ethenyl group; $V_1$ represents a hydrogen atom, a fluorine atom or a chlorine atom; m is 2, 3 or 4; and n is 0 or 1.

2. The silver halide emulsion of claim 1, wherein $R_1$ of formula (1) or (2) represents a phenyl group.

3. The silver halide emulsion of claim 1, wherein the electron attractive group contained in $R_3$ has a Swain-Lupton substituent constant F of not less than 0.24.

4. The silver halide emulsion of claim 3, wherein the electron attractive group contained in $R_2$ includes cyano, nitro, a perfluoroalkyl group, an alkoxycarbonyl group, an acyl group, a carbamoyl group, a carboxy group, hydroxy, methoxy, and ethoxy.

5. The silver halide emulsion of claim 1, wherein $R_3$ represents an unsubstituted methyl group or an unsubstituted ethenyl group.

6. The silver halide emulsion of claim 1, wherein $R_4$ represents an unsubstituted ethyl group, or an unsubstituted ethyl group, or an unsubstituted ethenyl group.

7. A silver halide light sensitive photographic material comprising a support having thereon a silver halide emulsion layer containing a silver halide emulsion and a compound represented by the following formula (1) or (2):

formula (1)

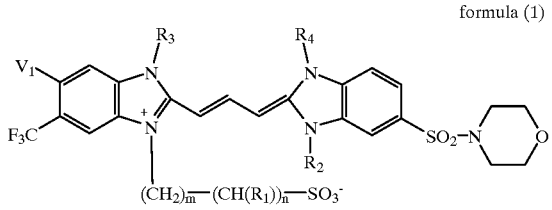

-continued formula (2)

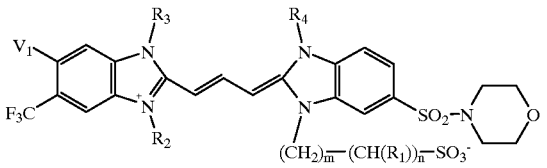

wherein $R_1$ represents a lower alkyl group, an aryl group or a 5- to 7-membered heterocyclic containing an oxygen atom, a sulfur atom, a nitrogen atom, or its condensed ring; $R_2$ represents a methyl group or an ethyl group, each of which is substituted with an electron-attractive group; $R_3$ represents a methyl group or an ethenyl group; $R_4$ represents a methyl group, an ethyl group or an ethenyl group; $V_1$ represents a hydrogen atom, a fluorine atom or a chlorine atom; m is 2, 3 or 4; and n is 0 or 1.

8. The silver halide photographic material of claim 7, said silver halide emulsion layer further containing a dye forming coupler.

9. The silver halide photographic material of claim 7, wherein $R_1$ of formula (1) or (2) represents a phenyl group.

10. The silver halide photographic material of claim 7, wherein the electron attractive group contained in $R_3$ has a Swain-Lupton substituent constant F of not less than 0.24.

11. The silver halide photographic material of claim 10, wherein the electron attractive group contained in $R_2$ includes cyano, nitro, a perfluoroalkyl group, an alkoxycarbonyl group, an acyl group, a carbamoyl group, a carboxy group, hydroxy, methoxy, and ethoxy.

12. The silver halide photographic material of claim 4, wherein $R_3$ represents an unsubstituted methyl group or an unsubstituted ethenyl group.

13. The silver halide photographic material of claim 4, wherein $R_4$ represents an unsubstituted methyl group, an unsubstituted ethyl group, or an unsubstituted ethenyl group.

* * * * *

UNITED STATES PATENT AND TRADEMARK OFFICE

CERTIFICATE OF CORRECTION

PATENT NO.: 6,093,527

DATED: July 25, 2000

INVENTORS: Nobuaki KAGAWA et al.

It is certified that an error appears in the above-identified patent and that said Letters Patent is hereby corrected as shown below:

Claim 1, Column 34, line 29, after "a sulfur atom", insert --,--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*